US005573151A

United States Patent [19]

Fildan

[11] Patent Number: 5,573,151

[45] Date of Patent: Nov. 12, 1996

[54] GARMENT HANGER WITH WAISTBAND AND STRAP CLIPS

[76] Inventor: Gerhard Fildan, Wohnpark Alte Erlaa, Anton-Baumgartner-Str.44, C 2 21 01, A-1232 Vienna, Austria

[21] Appl. No.: 292,380

[22] Filed: Aug. 18, 1994

[51] Int. Cl.[6] ..... A41D 27/22; G09F 3/00

[52] U.S. Cl. ..... 223/96; 223/85; 40/322

[58] Field of Search ..... 223/85, 88, 92, 223/91, 95, 96, 93; D6/315, 318, 326; 40/322

[56] References Cited

U.S. PATENT DOCUMENTS

| | | | |
|---|---|---|---|
| D. 305,484 | 1/1990 | Fildan . | |
| D. 327,578 | 7/1992 | Fildan . | |
| 4,450,639 | 5/1984 | Duester | 40/322 |
| 4,623,079 | 11/1986 | Terdrip et al. | 223/85 |
| 4,892,237 | 1/1990 | Duester et al. | 223/85 |
| 4,951,855 | 8/1990 | Jacobson et al. | 223/88 |
| 5,062,556 | 11/1991 | Willputz | 223/91 |
| 5,065,916 | 1/1991 | Fildan . | |
| 5,082,152 | 1/1992 | Cheu | 223/85 |

OTHER PUBLICATIONS

A&E "New Dimensions in Hanger Design" Catalog 1993 (p. 5).

*Primary Examiner*—C. D. Crowder
*Assistant Examiner*—Bibhu Mohanty
*Attorney, Agent, or Firm*—Herbert Dubno

[57] ABSTRACT

A hanger is provided in which the molded hooks for engagement with the waistband and the straps of undergarments or bathing suits are formed with a continuous rib from one free end to another. The hook is interchangeably mounted on the bar via a tongue arrangement providing a snap connection to the bar and the hook.

11 Claims, 6 Drawing Sheets

GARMENT HANGER WITH WAISTBAND AND STRAP CLIPS

FIELD OF THE INVENTION

The present invention relates to a garment hanger with molded integral clips for gripping the waistband of panties, bathing suit bottoms and the like and for engagement with the straps of brassieres, bathing suit tops and undergarments, particularly for the display and sale thereof. More particularly the invention relates to a garment hanger with improved stability during mounting of a garment on the hanger, greater capacity to inform the purchasing public of the size and character of the garment and which is simpler to store and assemble than earlier garment hangers.

BACKGROUND OF THE INVENTION

In my U.S. Pat. No. 5,065,916 I have described a garment hanger with molded integral clips at the end of a bar provided centrally with a hook, the clips having inwardly-extending formations above and below downwardly-turned extensions of the bar to receive straps of garments like bathing suits and brassieres. The clips also have fingers at the ends thereof for receiving the waists of panties, bathing suit bottoms or the like.

Such fingers have been found to be highly effective for the display of brassieres, bathing suits and undergarments generally, are comparatively inexpensive, and facilitate mounting of the garment on the hanger because of the shape and character of the clips.

In that patent I have described the provision of slots in the bar to accommodate a label, tag or the like providing information as to the garment, e.g. price or size.

Other hangers utilizing similar principles are found, for example, in my design patents U.S. Pat. Nos. Des. 305,484 and Des. 327,578 by way of example.

Mention may also be made of a more complex construction of a hanger in which the hook, although integral with the bar, has a cap which can be selectively fitted permanently thereon and is of a color which depends upon the size of the garment carried by the hanger. The cap is intended to be applied once the garment to be affixed to the hanger is determined.

One problem with existing hangers of the aforedescribed types and similar display and sale hangers, is the storage problem resulting from the fact that the hook is molded integrally with the bar.

While it is true that hangers with separable hooks and bars have been described in the art (see my Austrian Patent 370,967 of 25 May 1983, for example), these earlier systems have not gained widespread use heretofore.

Furthermore, the earlier system, in which a cap for color coding the hanger and providing information as to size, for example, of a garment to be attached thereto, has proved to be unsatisfactory in part because that cap was not removable.

OBJECTS OF THE INVENTION

It is, therefore, the principal object of the present invention to provide an improved garment hanger of the aforedescribed type whereby the aforementioned disadvantages can be obviated.

Another object of the invention is to provide a garment hanger which has all of the advantages of the hanger described in my U.S. Pat. No. 5,065,916 but which extends the principles thereof and, in particular, is of greater structural stability while affording the possibility of color coding and avoiding storage problems.

SUMMARY OF THE INVENTION

These objects and others are attained, in accordance with the present invention in a garment hanger having integrally-molded clips at opposite ends of a substantially straight bar having a hook which is preferably detachably connected to the bar and can be of a color selected to indicate size or other characteristics of the garment to be affixed to the hanger and wherein the clips are provided with a continuous rib extending from the lower retainer along the T-shaped head of the bar extension, along the upper retainer, along the horizontal member and along the downwardly-turned finger, over only part of the width thereof so that the clip is both strengthened where significant and is provided with the requisite retaining force for engagement with the garment.

The use of a rib which extends only part of the width of the clip allows a web of the molded material to project perpendicularly to the rib so that, in cross section, the retainers and members described, including the head of the T are of T cross section. This has been found to provide unusual results in that, as the injection-molded article cools, a shrinkage occurs at the clip which defines the gripping strength of the portions of the clip and, in particular, a strength which is greater than that available heretofore on imparts a weight for weight basis.

As a consequence, for example, the upper and lower retainers do not require multiple teeth as has been necessary heretofore in some constructions and only a single tooth may be provided to retain the respective straps.

Furthermore, the continuous rib structure strengthens the clips and limits any tendency to breakage.

It has been found to be advantageous to form the bar with upper and lower ribs, the upper rib being of greater width than the bottom rib.

The hook can be one of a set of hooks molded integrally of materials of different color so that, by selecting the hook of appropriate color, the hanger can be color coded for a particular garment size.

Advantageously, the hooks are provided at their lower ends with tongues which engage in slots formed in the bars and can have resilient tabs capable of locking the hooks to the bars the tabs being depressible for release of a hook from the bar.

According to another feature of the invention, the hooks are formed with protuberances on the sides thereof opposite the open sides and have circular fields carrying indicia as to the garment size or the like.

A garment hanger according to the invention can thus comprise:

- a molded one-piece bar having a substantially straight body formed on opposite ends with respective garment clips engageable with a waistband of a garment and with hanging straps of a garment, each of the clips comprising:
  - a downwardly turned extension of the bar inclined at an obtuse angle to the body,
  - a head transverse to the extension and co-planar therewith, an upper strap retainer extending from the head parallel to and above the extension, a horizontal member extending from an inner end of the upper strap retainer substantially parallel to the body outwardly and beyond the head, the head having a vertical array of teeth for engagement with a waistband, a descending member formed with teeth complementary to the array of teeth on the horizontal member and extending downwardly from the horizontal member, a lower strap retainer extending from the head below and parallel to the extension, each of the retainers having at least one tooth extending toward the extension, and a continuous stiffening rib extending over only part of a width of the clip and running from a free end of the lower strap retainer, along the lower strap retainer adjacent the tooth thereof, along the head opposite the teeth thereof, along the upper retainer adjacent the tooth thereof, along an inner edge of the horizontal member and along the vertical member following the teeth thereof to a free end of the vertical member; and a hook connected to the body and enabling the body to be suspended from the hook.

BRIEF DESCRIPTION OF THE DRAWING

The above and other objects, features, and advantages will become more readily apparent from the following description, reference being made to the accompanying drawing in which.

SPECIFIC DESCRIPTION

As can be seen from FIG. 1, the two basic elements of the hanger of the invention are a hook 100 and a bar 200, interconnected by a coupling system to be described in greater detail hereinafter.

Figure 2:
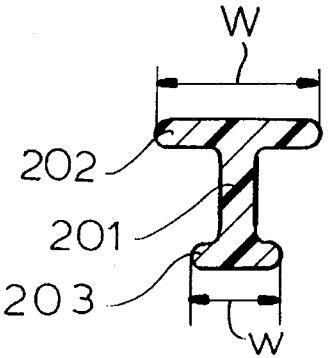
FIG. 2 is a cross sectional view taken along line II—II of FIG. 1.

The bar 200 is molded in one piece from a synthetic resin and generally is a translucent or transparent member with a web 201 bridging an upper rib 202 and a lower rib 203 (FIG. 2).

The upper rib 202 has a width W which is greater than the width w of the lower rib 203.

Figure 6:
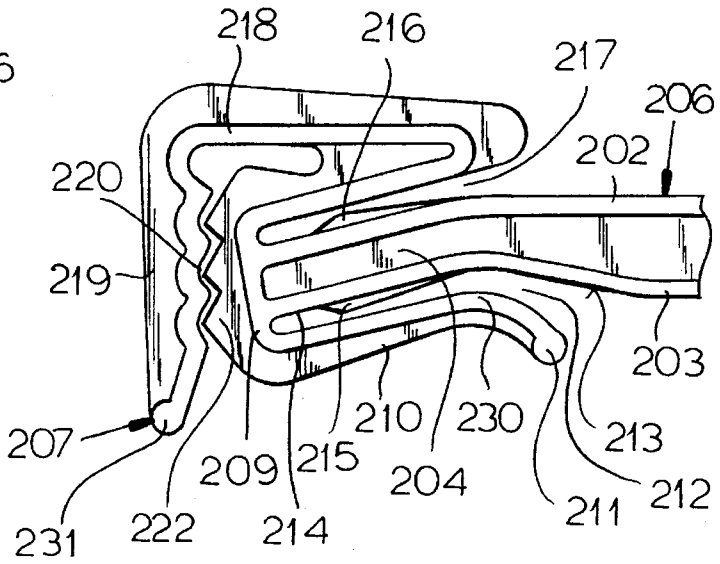
FIG. 6 is an elevational view drawn to a larger scale of one of the clips.

The bar 200 is substantially straight and is formed at its ends with downwardly-turned extensions 204 and 205 forming obtuse angles with the body 206 of the bar. The extensions 204 and 205 are each provided with a clip 207, 208. Since the clips are mirror symmetrical to one another, only the clip 207 will be described in greater detail, particularly with reference to FIG. 6.

The clip 207 comprises a head 209 forming the cross bar of the T at the end of the extension 204 and coplanar with the bar 206. From the bottom, the head leads into a lower retainer 210 which has a downwardly bent free extremity 211 defining a converging gap 212 with an inclined portion 213 of the lower side of the bar, enabling a strap to be inserted between the lower retainer 210 and the underside 214 of the extension 204. A single tooth 215 can be provided on the extension or on the lower retainer 210 to retain the strap. The lower retainer 210 is parallel to the extension 205.

Similarly, an upper retainer 215 extends parallel to the upper side of the extension 204 and via a single tooth 216 on this retainer or on the extension can hold a strap in place. The strap can be inserted into the converging gap 217 between the upper retainer 215 and the extension 204.

At its inner end, the upper retainer 216 is integral with a horizontal member 218 which projects beyond the head 209 and there is formed with a downwardly-turned finger or vertical member 219 provided with teeth 220 complementary to the teeth 221 on a web 222 of the head. Each of the members 209, 210, 215, 218 and 219 has a web unitary with a rib 230 which extends continuously from the free end 211 along the member 210, the head 209, the retainer 215, the horizontal member 218 and the vertical member 219 to the free end 231 so that each of these structures is of T cross section. The clip shown in FIG. 6 operates in the manner described for the clips of U.S. Pat. No. 5,065,916.

Figure 3:
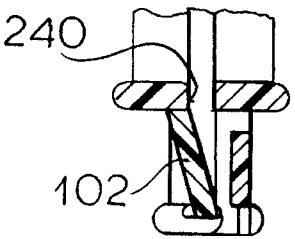
FIG. 3 is a cross sectional view through the releasable connector between the hook and the bar body of the hanger.

The body 206 of the hanger is formed with a slot 240 at its upper side, into which a tongue 101 of the hook 100 can engage. The tongue 101 has a spring-biased tab 102 which projects out of the plane of the tongue as shown in FIG. 3 to engage below the edge of the slot 240 and thereby hold the hook 100 in engagement with the bar. When the tab 102 is depressed inwardly, it can clear the lower edge of the slot 240 and enable the hook to be withdrawn. The hook automatically locks in place when the tongue is inserted into the slot.

Figure 1:
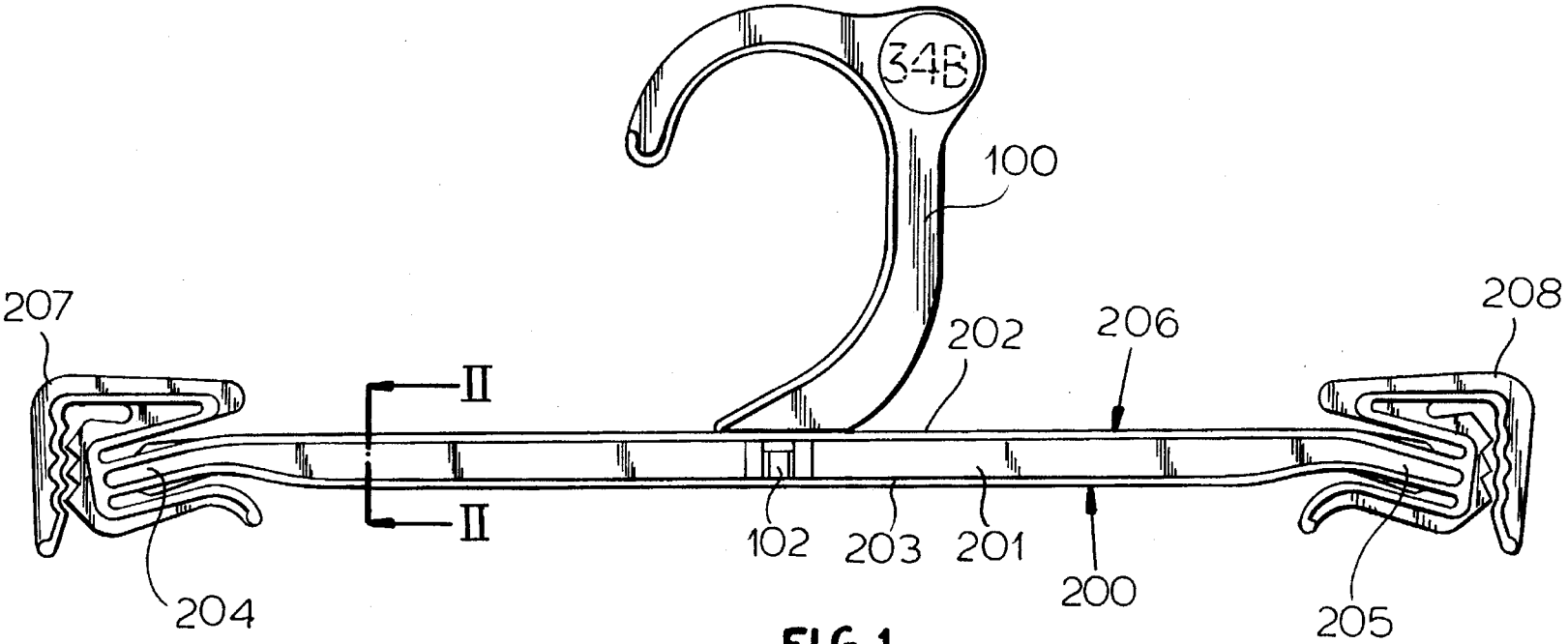
FIG. 1 is an elevational view of a hanger according to the invention.

As is also apparent from FIGS. 1 and 3, the hook 100 also has a web 103 adjoining a rib 104 which, in this case, extends along the interior or open side of the hook. On its opposite side, a protuberance, lug, projection or ear 105 is formed and is molded with a circular field 106 containing indicia 107 of the size of the garment displayed on the hanger.

Figure 4:
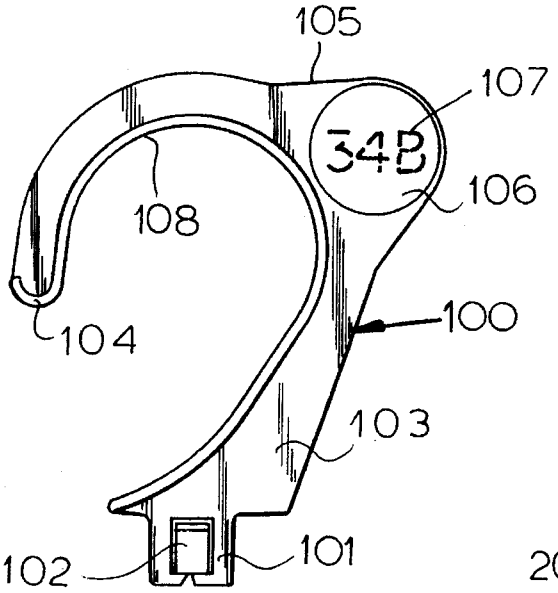
FIG. 4 is an elevational view of the hook of the hanger of FIG. 1 shown separate from the bar.
Figure 5:
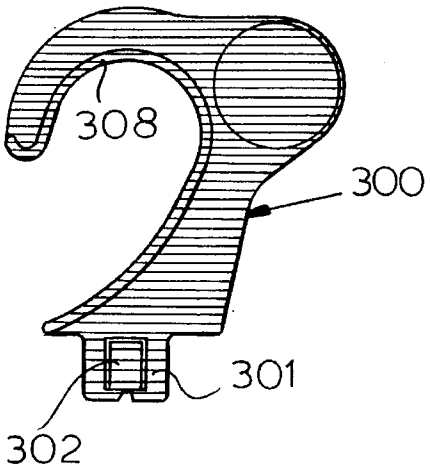
FIG. 5 is an elevational view of another hook shown to be of a different color from that of FIG. 4 by line shading for the color blue.
Figure 7:
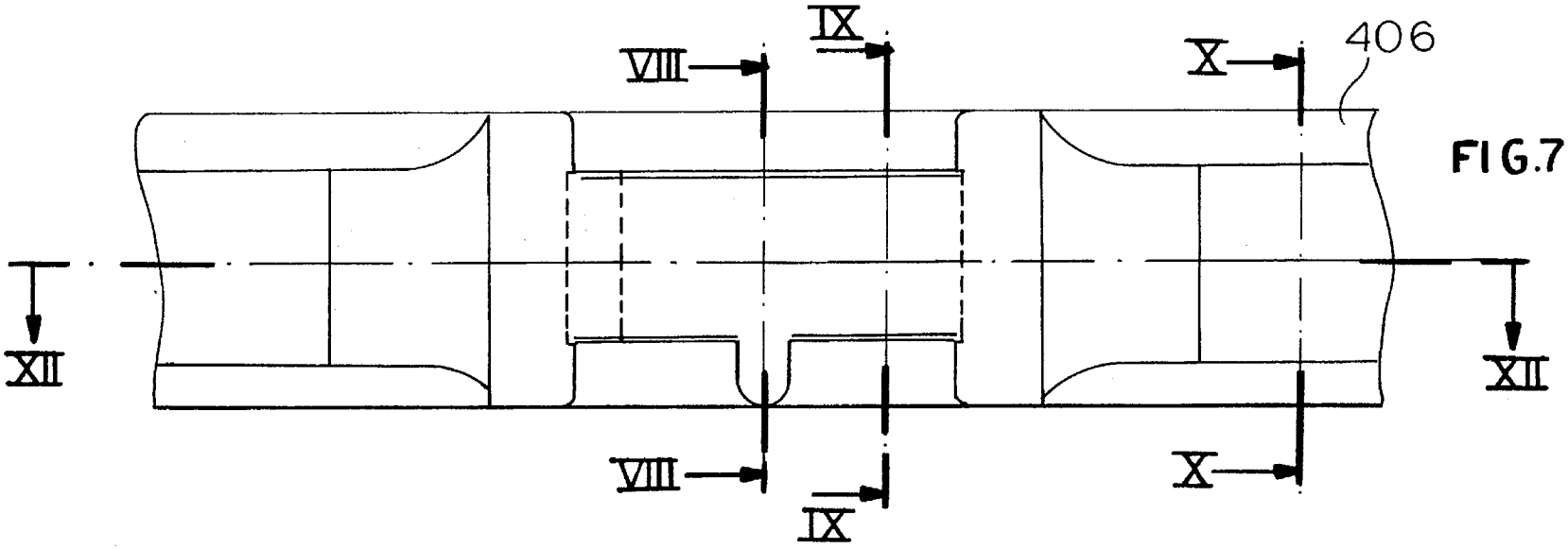
FIG. 7 is an enlarged front elevational view of the bar provided with an improved catch for detachably securing the hanger hook to the bar.
Figure 10:
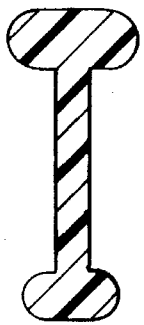
FIG. 10 is a cross sectional view taken along the line X—X of FIG. 7.
Figure 9:
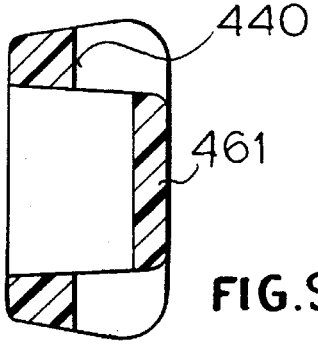
FIG. 9 is a cross sectional view taken along the line IX—IX of FIG. 7.
Figure 8:
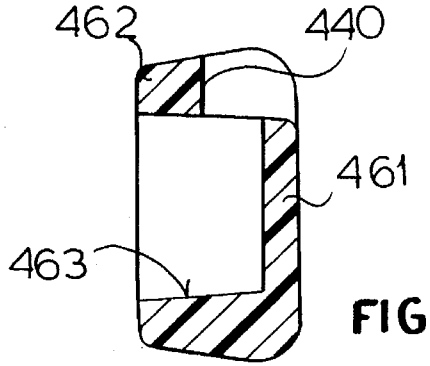
FIG. 8 is a cross sectional view taken along the line VIII—VIII of FIG. 7.
Figure 11:
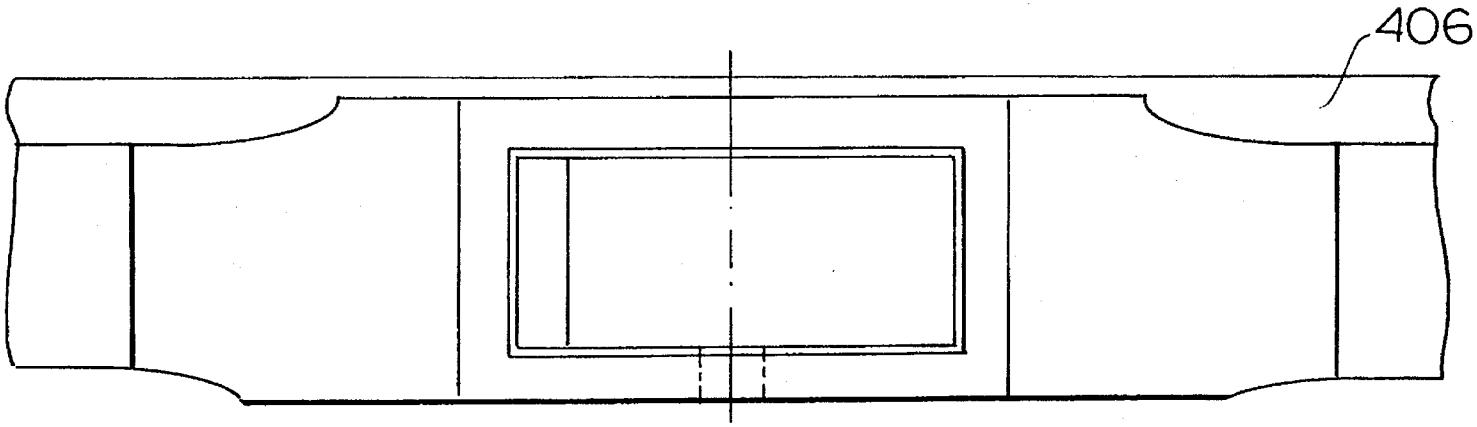
FIG. 11 is a rear elevational view of the catch-forming region of the bar.
Figure 12:
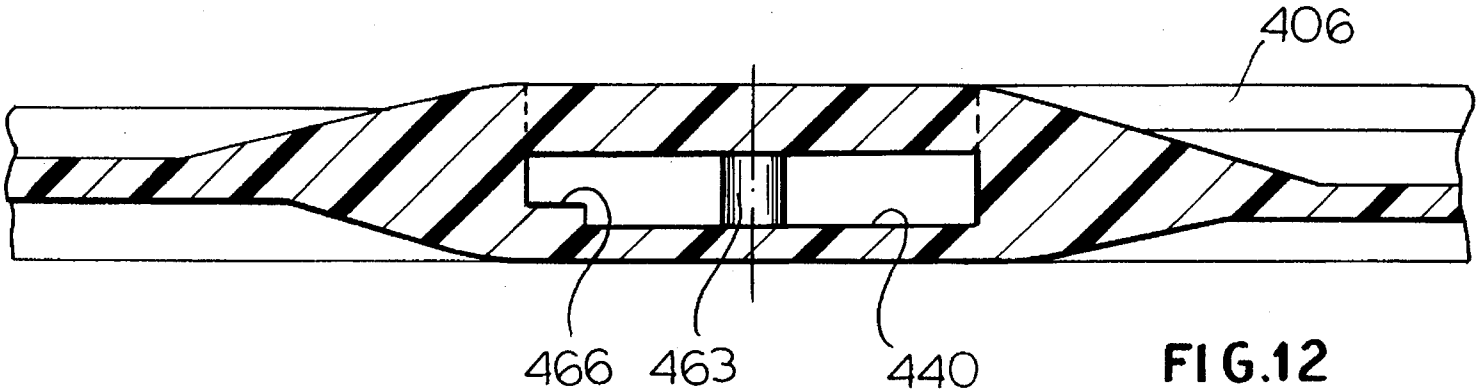
FIG. 12 is a cross sectional view taken along the line XII—XII of FIG. 7.
Figure 13:
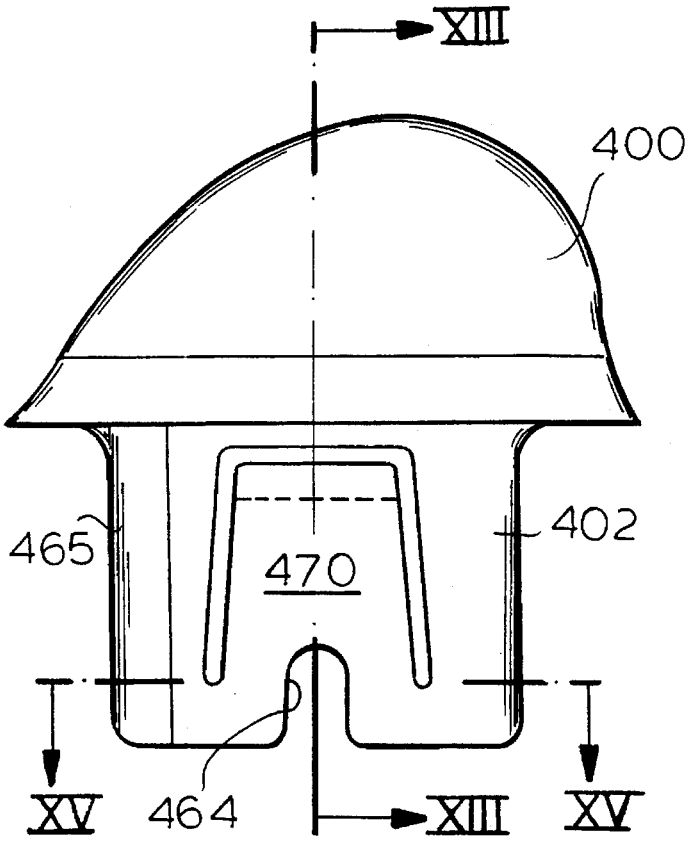
FIG. 13 is a detail view drawn to a larger scale than FIGS. 1–5 and corresponding to the scale of FIG. 7 showing the tab adapted to fit into the pocket of the catch of FIGS. 7–12.
Figure 14:
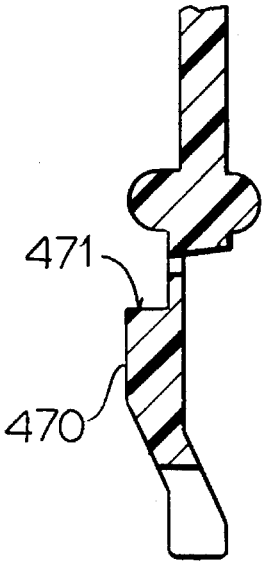
FIG. 14 is a cross sectional view taken along the line XIV—XIV of FIG. 13.
Figure 15:
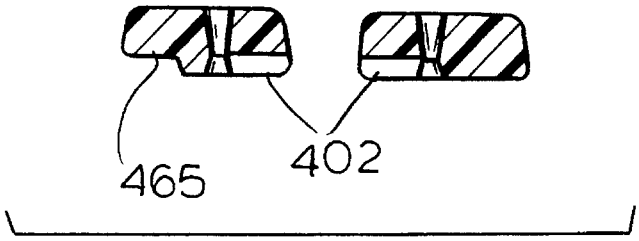
FIG. 15 is a cross sectional view taken along the line XV—XV of FIG. 13.

As FIGS. 4 and 5 show, the hooks can be of a contrasting coloration. For example, the hook 100 can be clear and transparent while the hook 300 of FIG. 5 is of a blue color signifying a particular size garment different from the size represented by the coloration of the hook 100. In addition, the color coding may represent different diameters of the openings 108 and 308 of the hook. The tongue and tab structures 101, 102 and 301, 302, respectively, may be identical so that the hooks can be used interchangeably for the same bar 206.

It will be apparent that the bars and hooks can be shipped separately. At the premises of the user the hooks can be snapped into the slots 240 with a color appropriate to the size or character of the goods to be supported on the hanger.

Since the hooks are not present until assembly at use on the bars, the tangling of the bars and difficulties hitherto encountered with storing them and handling them, can be avoided. The relevant tab enables the hook to be connected with the bar simply by full insertion of the respective tongue in the slot of the bar. The garment can then be suspended from the hanger.

As can be seen from FIGS. 7–15, the body 406 of the hanger can be formed with a slot 440 into which the tap 402 of the hook 400 can be inserted.

The slot 440 is delimited by a rear wall 461 and a front bar 462 and at the lower center of this slot, a formation 463 is provided into which a notch 464 of the tab can fit. The notch 464 and the projection 463 spanning the slot 440 serve to ensure a secure fit of the tab 402 in the slot.

In addition, the tab 402 is provided with a setback 465 adapted to receive a step 466 in the slot 440 to ensure that the tab 402 cannot be inserted into the slot 440 in a reversed orientation.

As has been described, the tab 402 has a tongue 470 with an edge 471 engaging beneath the bar 462 to retain the tab in the slot upon assembly of the hook into the bar.

A major advantage of the present system is that the hooks can be detachable from the hanger bars so that the supplier of the garment can deliver the garment already mounted on the bar enabling the hook to be affixed at the display location. For sale, the hook can then be removed and reused. The hooks can be of various sizes for use with a given bar and can have display areas for a logo or other indicia.

Figure 16C:
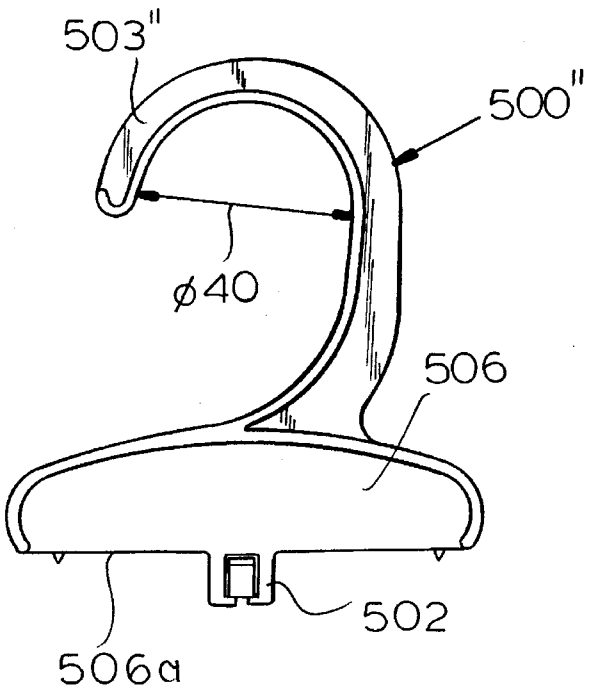
FIGS. 16*a*, 16*b* and 16*c* are elevational views of a set of respective interchangeable hooks which can be used with the bar of the invention.
Figure 16B:
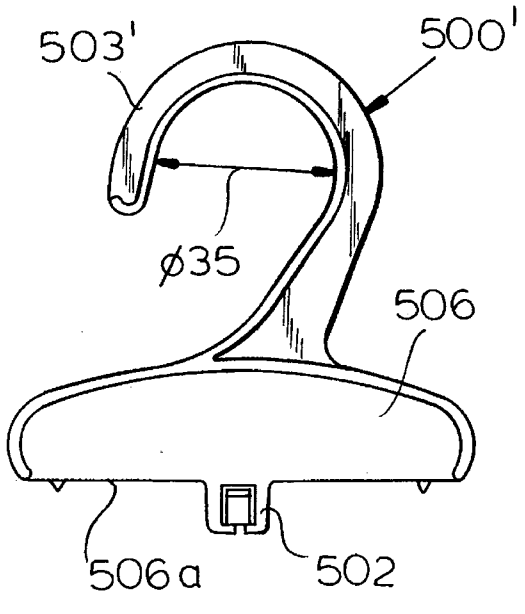
Figure 16A:
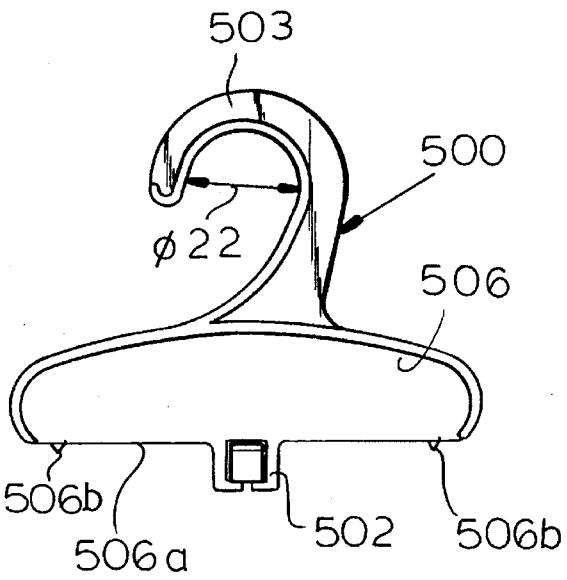

In FIGS. 16*a* through 16*c*, for example, I have shown hooks 500, 500' and 500", all of which have the identical spring tabs 502 enabling these hooks to be removably connected to a bar, e.g. the bar of FIG. 1 so that any one of these hooks may be used interchangeably with the bar and, upon sale of the garment mounted upon the bar, can be removed for reuse of the hook. The hooks can have bent members 503' and 503" differently dimensioned as shown for engagement with different size racks.

According to a feature of the invention, the bases of the hooks may be enlarged aprons 506 which can be provided with size indicia, logos representing the retail establishment or manufacture, or other descriptive indicia. Since the lower edges 506*a* of these aprons rest upon the upper surfaces of he bar, the hooks are very stable.

According to a feature of the invention, the lower edges 506*a* can be provided with points 506*b* which can penetrate into the upper edges of the bar or can engage in detents therein to stabilize the hooks against twisting when the hooks are mounted on a bar.

The hooks can, in addition, be clear or opaque or can be of different colors or can have only their display areas 506 of different colors to facilitate attachment of the correct hook to a bar upon assembly of the hanger.

I claim:

1. A garment hanger, comprising:

a molded one-piece bar having a substantially straight body formed on opposite ends with respective garment clips engageable with a waistband of a garment and with hanging straps of a garment, each of said clips comprising:

a downwardly turned extension of said bar inclined at an obtuse angle to said body, a head transverse to said extension and coplanar therewith, an upper strap retainer extending from said head parallel to and above said extension, a horizontal member extending from an inner end of said upper strap retainer substantially parallel to said body outwardly and beyond said head, said head having a vertical array of teeth for engagement with a waistband, a descending member formed with teeth complementary to said array of teeth on said horizontal member and extending downwardly from said horizontal member, a lower strap retainer extending from said head below and parallel to said extension, each of said retainers having at least one tooth extending toward said extension, and a continuous stiffening rib extending over only part of a width of said clip and running from a free end of said lower strap retainer, along said lower strap retainer adjacent said tooth thereof, along said head opposite said teeth thereof, along said upper retainer adjacent said tooth thereof, along an inner edge of said horizontal member and along said vertical member following the teeth thereof to a free end of said vertical member;

a hook connected to said body and enabling said body to be suspended from said hook, said body being formed with ribs along opposite longitudinal sides thereof and running along said extensions to said heads, the rib on an upper side of said body having a width greater than the rib on a lower side thereof; and coupling means on said body and said hook for detachably mounting said hook on said body.

2. The hanger defined in claim 1 wherein said hook is one of a plurality of hooks of different colors representing information as to garments displayed on the hanger and selectively affixed to said bar in accordance with garments secured in said clips.

3. The hanger defined in claim 1 wherein said coupling means includes a slot formed in said body and a flat tongue received in said slot and formed on said hook.

4. The hanger defined in claim 3 wherein said tongue is formed with a flat spring tab deflectable by a user to enable release of a hook from a bar.

5. The hanger defined in claim 1 wherein said hook is a flat molded member formed unilaterally with a lug provided with a circular field projecting from said hook laterally and formed with indicia representing a size of a garment to be displayed on the hanger, and with a tongue coplanar with said lug and insertable through a slot formed in said body and constituting said coupling means.

6. The hanger defined in claim 5 wherein said hook is one of a plurality of hooks of different colors representing information as to garments displayed on the hanger and selectively affixed to said bar in accordance with garments secured in said clips.

7. The hanger defined in claim 1 wherein each of said retainers has only a single tooth for engagement with a strap.

8. The hanger defined in claim 1 wherein said hook is formed with a display area.

9. The hanger defined in claim 8 wherein said display area is formed as an ear along a bent portion of said hook.

10. The hanger defined in claim 8 wherein said display area is an elongated apron which is formed along a lower edge with a pair of points engaging in said upper edge of said body.

11. The hanger defined in claim 1 wherein said hook is one of a set of hooks of different sizes interchangeably mountable on said body.

* * * * *